US005454868A

United States Patent [19]

Mendez

[11] Patent Number: 5,454,868

[45] Date of Patent: Oct. 3, 1995

[54] COATING DEVICE

[75] Inventor: Benjamin G. Mendez, Heidenheim, Germany

[73] Assignee: J. M. Voith GmbH, Heidenheim, Germany

[21] Appl. No.: 300,165

[22] Filed: Sep. 2, 1994

[30] Foreign Application Priority Data

Sep. 9, 1993 [DE] Germany ..... 43 30 545.8

[51] Int. Cl.[6] ..... B05C 1/00

[52] U.S. Cl. ..... 118/216; 15/256.5; 15/256.51; 15/256.52; 101/365; 118/110; 118/118; 118/119; 118/244; 118/258; 118/262

[58] Field of Search ..... 118/110, 118, 118/119, 123, 216, 222, 244, 258, 262, 413; 492/39, 40; 101/157, 169, 365; 15/256.5, 256.51, 256.52; 162/281

[56] References Cited

U.S. PATENT DOCUMENTS

| | | | |
|---|---|---|---|
| 4,456,637 | 6/1984 | Takeda et al. | 118/118 |
| 5,103,759 | 4/1992 | Henseler et al. | 118/118 |
| 5,133,281 | 7/1992 | Eriksson | 118/412 |
| 5,155,910 | 10/1992 | Henseler et al. | 29/895.213 |

FOREIGN PATENT DOCUMENTS

| | | | |
|---|---|---|---|
| 3923850 | 1/1991 | Germany . | |
| 1620164 | 1/1991 | U.S.S.R. | 492/40 |
| 8705947 | 10/1987 | WIPO | 118/110 |

*Primary Examiner*—Karen M. Hastings
*Assistant Examiner*—Laura E. Edwards
*Attorney, Agent, or Firm*—Marshall, O'Toole, Gerstein, Murray & Borun

[57] ABSTRACT

A coating device includes a plurality of parallel coating blade lamellae made from highly wear-resistant material. The lamellae are disposed against one another in a housing and held thereby, forming a lamella packet wherein each lamella of the packet is disposed at the same inclination with respect to a plane perpendicular to a longitudinal axis of the packet. The inclination of the lamellae is adjustably controlled by at least one adjusting device acting on the packet. Thus, a change in lamellae inclination also changes a step-wise configuration of a surface contour formed by neighboring lamellae of the packet.

12 Claims, 2 Drawing Sheets

COATING DEVICE

BACKGROUND OF THE INVENTION

1. Field of the Invention

The invention relates to coating devices, and in particular to coating devices having blades utilized for coating paper or cardboard.

2. Description of Related Technology

It is known in the art of paper coating to utilize peripherally grooved coating blades which volumetrically meter a coating material via said grooves as measured by the cross-sectional area of the grooves. Coating blades of this type are relatively expensive to use because they wear rapidly, requiring frequent and rapid blade exchange. The production of coating blades from highly wear-resistant material presents difficulties because, for example, the use of wear-resistant material can reduce accuracy with respect to the size of the blade groove cross-section and/or the roundness thereof.

An attempt has been made to solve the blade wear problem by providing a coating device comprising a plurality of aligned coating disks having various hardness and diameters as disclosed in DE 39 23 850.

SUMMARY OF THE INVENTION

It is an object of the invention to overcome one or more of the problems described above. It is also an object of the invention to provide a coating device or element which reduces to a minimum operational hindrances caused by wear on a coating blade.

According to the invention, a coating device is provided which includes a plurality of parallel coating blade lamellae made from highly wear-resistant material. The lamellae are disposed against one another in a housing and held thereby, forming a lamella packet wherein each lamella of the packet is disposed at the same inclination with respect to a plane perpendicular to a longitudinal axis of the packet. The inclination of the lamellae is adjustably controlled by at least one adjusting device acting on the packet. Thus, a change in lamellae inclination also changes a step-wise configuration of a surface contour formed by neighboring lamellae of the packet.

Other objects and advantages of the invention will be apparent to those skilled in the art from the following detailed description taken in conjunction with the drawings and the appended claims.

DETAILED DESCRIPTION OF THE INVENTION

According to the invention, coating blade wear is compensated for by adjusting the inclination of coating blade lamellae in a coating blade packet, causing the simple displacement of individual lamella of a coating blade packet. Also according to the invention, it is possible to significantly increase the lifetime of a coating device by using a rotating coating blade packet. Such a packet can also be designed so that the inclination of the individual coating blade lamellae is adjustable. However, in such an embodiment, action of the resting displacing elements must be made possible, for example, with the aid of an axial ball bearing.

Figure 1:
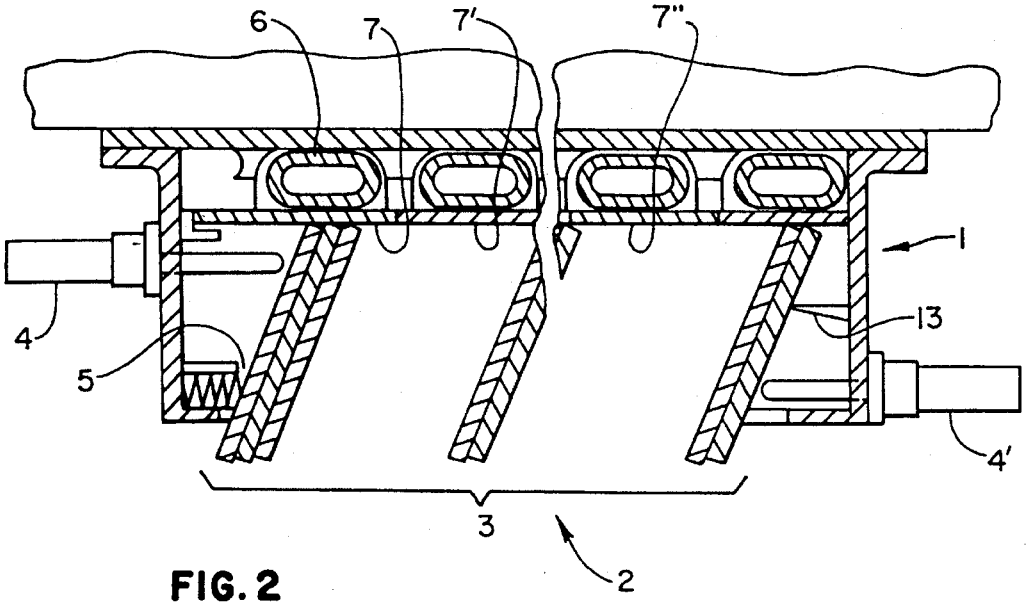
FIG. 1 is an axial-sectional view of a coating device according to the invention.

According to FIG. 1, coating blade lamellae, generally designated 2, made of highly wear-resistant material are combined to form a packet 3 disposed in a housing, generally designated 1. The lamellae have a thickness of between about 0.2 mm and about 0.6 mm. The lamellae 2 are pressed against one another by adjusting devices 4 and 4' mounted on the housing 1. The devices 4 and 4' also adjust the inclination of the lamellae 2. A stop 13 abuts against a front face of the packet 3 at a central region thereof. The stop 13 provides a point of rotation for the lamella packet 3. A cylindrical worm spring 5 abuts against an opposite side of the packet 3 in a region near a substrate to be coated (not shown) and provides support for the packet by providing a force counter to the force of the adjusting device 4'. Pressure strips 7, 7', 7", etc., made of material having a very low surface friction (e.g., made from a polished plate or polymer sold under the trademark "Teflon" (E.I. du Pont de Nemours, Co., Wilmington, Del.)) are disposed above the lamella packet. The strips 7, 7', 7", etc. permit adjustable movement of the coating blade lamellae 2 with low friction in spite of the contact pressure placed against the lamellae 2 by pressing devices in the form of pressure tubings 6 which are disposed along a length of the packet 3 and at a back portion thereof. The pressure tubings 6 provide local contact pressure to the individual lamellae and thus control the contact pressure from the lamellae to a substrate to be coated in a direction toward the contact line between the lamellae and the substrate. The pressure inside of the pressure tubings 6 can be adjusted so that the contact pressure of the coating blade packet 3 on a paper web (not shown) or a counter roll (not shown) guiding a paper web is as uniform as possible.

The material of the coating blade lamellae 2 is chosen from known wear-resistant materials; especially preferred materials are carbides, oxides or other sintered materials. Hydraulic or pneumatic systems may be utilized as adjusting devices. Adjusting devices according to the invention also include magnetostrictive and piezoelectric devices.

Figure 2:
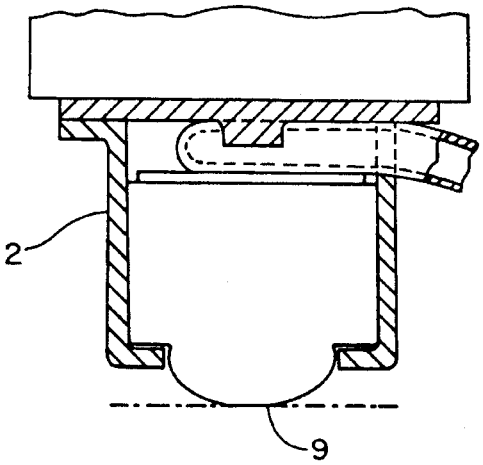
FIG. 2 is a cross-sectional view of the device of FIG. 1.

With reference to FIG. 2, an individual coating blade lamella 2 includes a projection 9 in a region of the coating surface of the lamella packet 3.

In FIG. 1, intermediate spaces between neighboring coating blade lamellae 2 are shown which are designed with angular, preferably rectangular edges, forming a step-wise configuration of a coating surface contour of the packet 3. Such edges form the metering cross-sectional areas between the individual lamellae 2. By changing the inclination of the lamella packet 3, the size of the metering cross-sections are altered. As a result, wear of the individual lamellae can be compensated for and a constant outlet cross-section (metering cross-sectional area) can be maintained during a prolonged operation of the coating device.

The lamella packet 3 is ground, so that the coating blade lamellae 2 will have an absolutely equal "height dimension" (alignment, for example, between the contact pressure tubings 6 and projections 9). This also favorably results in a somewhat broader, flat contact surface of the coating blade lamellae on a substrate.

Figure 3:
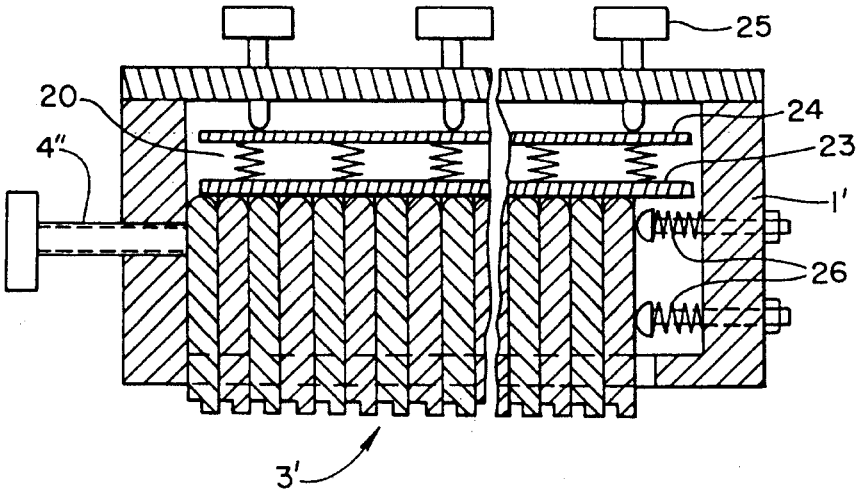
FIG. 3 is an axial-sectional view of a second embodiment of a coating device according to the invention.

In an embodiment of a coating device according to the invention shown in FIG. 3, a lamella packet 3' is held in a housing 1' similar to the lamella packet 3 and housing 1 shown in FIG. 1. However, in the embodiment shown in FIG. 3, instead of pressure tubings 6, spring elements 20 are provided for pressing the lamellae against a paper web or counter roll. Using pressure pads and slide strips 23 and 24, respectively, disposed at either side of the spring elements 20, contact pressure is applied to the packet 3' via positioning elements 25. To support the coating blade packet 3', cylindrical worm springs 26 are disposed in a region above and below the coating blade packet 3' at one side thereof, the springs 26 being disposed within the housing 1'. An adjusting device 4" presses against the lamellae packet 3' at a side thereof opposite the worm springs 26.

Figure 4:
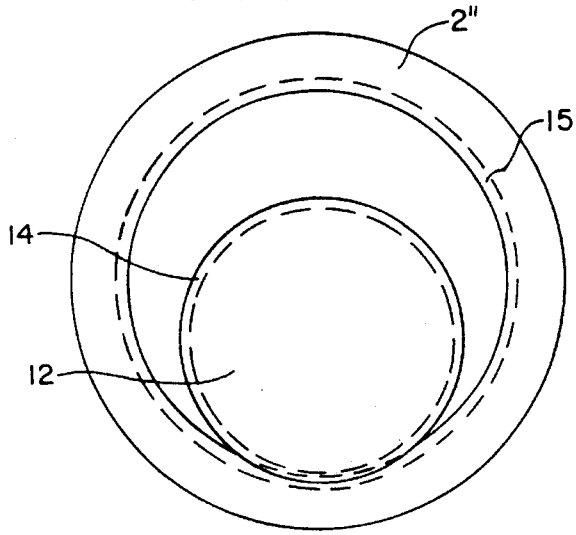
FIG. 4 is a partial front-elevational view of a third embodiment of a coating device according to the invention showing a rotatably driveable coating blade packet.
Figure 5:
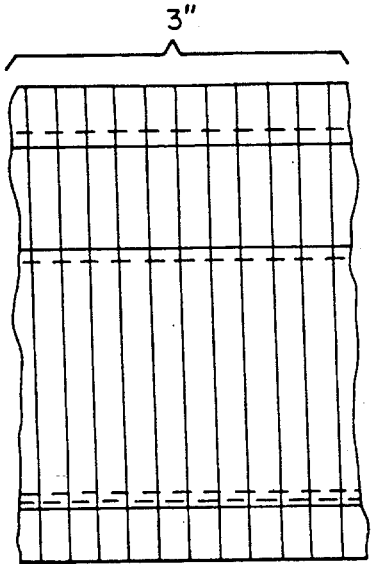
FIG. 5 is a partial side-elevational view of the coating device of FIG. 4.
Figure 6:
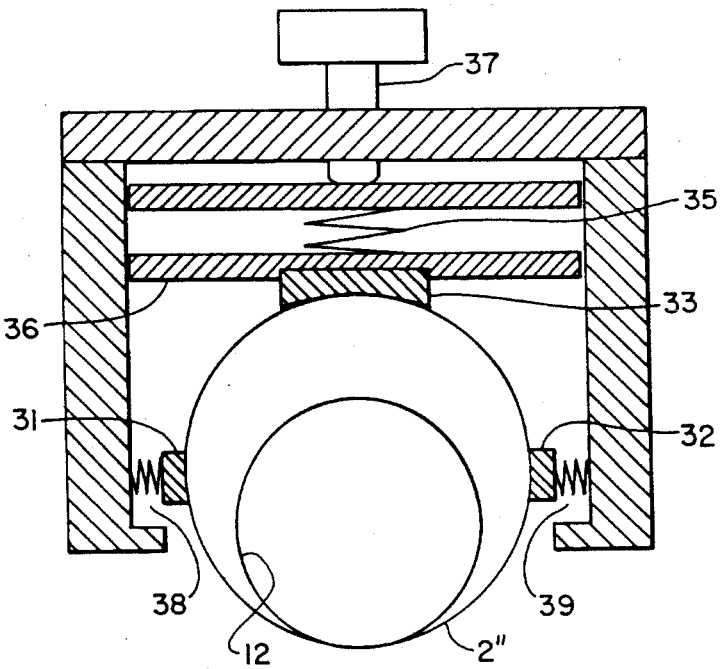
FIG. 6 is a reduced cross-sectional view of the coating device of FIG. 4.

FIGS. 4 to 6 illustrate a coating device according to the invention having a coating blade packet 3" consisting of annular coating blade lamellae 2". The packet 3" is rotatably driven by a central drive rod 12 disposed eccentrically to the coating blade lamellae 2". The drive rod 12 has outer toothing 14. The toothing 14 engages a corresponding inner toothing 15 of the individual coating blade lamellae 2". In order to provide lamellae support and adjustment similar to the embodiments of the invention shown in FIGS. 1 and 3, the coating blade packet 3" of FIGS. 4–6 is preferably supported at the ends thereof by an axial ball bearing (axially acting). The rate of rotation of the coating blade packet during operation is preferably less than 1 rpm.

With reference to FIG. 6, supporting devices for the lamellae packet 3" are provided in the form of guide shoes 31, 32, and 33, which are preferably made of polyurethane or other synthetic material resistant to sliding wear, such as polytetrafluoroethylene (PTFE, e.g. "Teflon"). Springs 38, 39, and 35 mounted on the device, press against the shoes 31, 32, and 33, respectively, and provide contact pressure to the packet 3". Adjusting devices 37 are provided for placing scraping pressure (i.e., doctoring pressure) on the packet 3" as are provided in the other embodiments described herein.

Figure 7A:
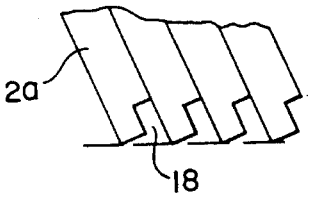
FIG. 7*a* is a partial cross-sectional view of coating blade lamellae taken in a direction of a longitudinal axis of a lamella packet.
Figure 7B:
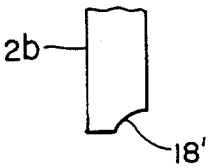
FIG. 7*b* is a partial cross-sectional view of a second embodiment of a coating blade lamella taken in a direction of a longitudinal axis of a lamella packet.
Figure 7C:
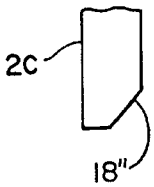
FIG. 7*c* is a partial cross-sectional view of a third embodiment of coating blade lamella taken in a direction of a longitudinal axis of a lamella packet.

FIGS. 7*a*, 7*b*, and 7*c* illustrate individual coating lamella 2*a*, 2*b*, and 2*c*, respectively, according to the invention. A coating surface of the lamella 2*a*, 2*b*, and 2*c* is defined by a recess 18, 18', and 18", respectively. The orientation of the coating blade lamellae is preferably as shown in FIG. 1 so that if the inclination of the lamellae is increased, the intermediate space between neighboring coating blade lamellae will also increase. By shaping the lamellae as shown in FIGS. 7*a*–7*c*, an outlet cross-sectional area for the metering of coating material can be achieved, even at an angle of inclination of 0° (with respect to a direction perpendicular to the packet axis). However, the recesses should not be too large in order to provide for sufficient variations of the outlet cross-sectional area in case of wear of the lamellae.

If the coating blade lamellae are inclined in the direction shown in FIG. 7*a*, the inclination would need to be set very large at the beginning of the coating operation (i.e. for a new lamella packet), with the inclination being gradually reduced (i.e., directed more upright) as the lamellae in the packet become worn. However, such an embodiment does not appear to result in relatively long-lived operation.

The foregoing detailed description is given for clearness of understanding only, and no unnecessary limitations should be understood therefrom, as modifications within the scope of the invention will be apparent to those skilled in the art.

I claim:

1. A coating device comprising a plurality of parallel coating blade lamellae made from highly wear-resistant material, said lamellae being disposed against one another in a housing and being held thereby to form a lamella packet, each lamella in said packet being disposed in the same inclination with respect to a plane perpendicular to a longitudinal axis of the packet, said inclination being adjustably controlled with respect to the direction of the longitudinal axis of the packet by at least one adjusting device mounted on said housing which acts on the packet, wherein a change in lamellae inclination also changes a step-wise configuration of a surface contour formed by neighboring lamellae of the packet.

2. The coating device of claim 1 comprising pressing devices disposed along a length of the packet and at a back portion thereof, said pressing devices locally controlling contact pressure between the lamellae and a substrate to be coated in a direction toward a contact line between the lamellae and the substrate.

3. The coating device of claim 2 wherein the pressing devices are pressure tubings.

4. The coating device of claim 1 wherein said adjusting device is disposed against a front face of the lamella packet and said coating device further comprises a stop disposed at said front face in a central region thereof and a spring disposed at an opposite face of the packet and in a region near a substrate to be coated, said spring providing a force counter to the force of the adjusting device.

5. The coating device of claim 4 wherein said stop provides a point of rotation for the packet.

6. The coating device of claim 1 wherein said packet is made of annular coating blade lamellae having inner toothing rotatably driveable by a drive rod defining corresponding outer toothing, said drive rod being disposed eccentrically within the packet.

7. The coating device of claim 6 wherein the rate of rotation of the packet is less than 1 rpm.

8. The coating device of claim 1 wherein the lamellae have rectangular coating edges.

9. The coating device of claim 1 wherein the coating lamellae having coating edges defining recesses.

10. The coating device of claim 9 wherein the recesses are disposed in such a way that, upon increasing the inclination of the coating blade lamellae, an intermediate space between the lamellae is increased.

11. The coating device of claim 1 wherein each lamella defines a projection extending in a direction of the plane of the lamella, said lamellae defining gaps therebetween, said gaps forming metering cross-sectional areas in the region of projections.

12. The coating device-of claim 1 wherein the lamellae have a thickness of between about 0.2 mm and about 0.6 mm.

* * * * *